US012553661B2

(12) United States Patent
Miller et al.

(10) Patent No.: US 12,553,661 B2
(45) Date of Patent: Feb. 17, 2026

(54) TRIM BREAKER WITH LIGHT-DIFFUSING OPTICAL FIBER FOR VACUUM INSULATED STRUCTURE

(71) Applicant: WHIRLPOOL CORPORATION, Benton Harbor, MI (US)

(72) Inventors: Stephen M. Miller, Benton Harbor, MI (US); Devidas B. Raskar, Plymouth, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 90 days.

(21) Appl. No.: 18/451,503

(22) Filed: Aug. 17, 2023

(65) Prior Publication Data

US 2025/0060148 A1 Feb. 20, 2025

(51) Int. Cl.
*F25D 23/08* (2006.01)

(52) U.S. Cl.
CPC ..... *F25D 23/085* (2013.01); *F25D 2201/14* (2013.01)

(58) Field of Classification Search
CPC ..... F25D 23/085; F25D 2201/14
USPC ..... 220/592.07
See application file for complete search history.

(56) References Cited

U.S. PATENT DOCUMENTS

| | | | | |
|---|---|---|---|---|
| 8,663,417 | B2 | 3/2014 | Braun | |
| 10,914,511 | B2 | 2/2021 | Naik et al. | |
| 10,914,514 | B1 | 2/2021 | Hunter et al. | |
| 11,079,171 | B2 | 8/2021 | Marinello et al. | |
| 11,085,691 | B2 | 8/2021 | Ickes et al. | |
| 11,300,353 | B2 | 4/2022 | Choi et al. | |
| 11,340,008 | B1 | 5/2022 | Hunter et al. | |
| 2016/0010833 | A1* | 1/2016 | Fewkes | F21V 17/06 362/558 |
| 2018/0194113 | A1* | 7/2018 | Klein | B60Q 1/00 |
| 2021/0325106 | A1* | 10/2021 | Marinello | F25D 23/085 |
| 2023/0194157 | A1* | 6/2023 | Hong | F25D 29/005 362/92 |
| 2024/0191939 | A1* | 6/2024 | Hong | F25D 27/005 |

(Continued)

FOREIGN PATENT DOCUMENTS

| | | | | |
|---|---|---|---|---|
| CN | 212538413 U | * | 2/2021 | |
| CN | 117329757 A | * | 1/2024 | F25D 23/028 |
| DE | 102012015400 A1 | | 11/2013 | |

(Continued)

*Primary Examiner* — Orlando E Aviles
*Assistant Examiner* — Niki M Eloshway
(74) *Attorney, Agent, or Firm* — Price Heneveld LLP

(57) ABSTRACT

A vacuum insulated refrigerator includes a cabinet defining at least one compartment. The cabinet includes a wrapper, a liner assembly, and a trim breaker assembly coupled to the wrapper and the liner assembly. The trim breaker assembly defines a wrapper groove to receive an edge of the wrapper and at least one liner groove to receive at least one edge of the liner assembly. A wrapper light-diffusing optical fiber is disposed in the wrapper groove. The wrapper light-diffusing optical fiber is configured to diffuse light within the wrapper groove. At least one liner light-diffusing optical fiber is disposed in the at least one liner groove. The at least one liner light-diffusing optical fiber is configured to diffuse light within the at least one liner groove. A light reactive adhesive is disposed in the wrapper groove and in the at least one liner groove.

19 Claims, 11 Drawing Sheets

(56) References Cited

U.S. PATENT DOCUMENTS

| | | | | | |
|---|---|---|---|---|---|
| 2025/0035372 | A1 * | 1/2025 | Kozinski | ..... | F25D 27/005 |

FOREIGN PATENT DOCUMENTS

| | | | | | |
|---|---|---|---|---|---|
| DE | 102017115002 | A1 | 1/2019 | | |
| EP | 3421912 | B1 | 3/2021 | | |
| JP | 2003246970 | A * | 9/2003 | | |
| KR | 20230011154 | A * | 1/2023 | ..... | D06F 37/28 |
| WO | WO-2019083920 | A1 * | 5/2019 | ..... | G02B 6/001 |

* cited by examiner

TRIM BREAKER WITH LIGHT-DIFFUSING OPTICAL FIBER FOR VACUUM INSULATED STRUCTURE

BACKGROUND OF THE DISCLOSURE

The present disclosure generally relates to a light guide for a trim breaker assembly for an appliance, and more specifically, to a light-diffusing optical fiber for a trim breaker assembly for a vacuum insulated structure.

SUMMARY OF THE DISCLOSURE

According to one aspect of the present disclosure, a vacuum insulated refrigerator includes a cabinet defining at least one compartment. The cabinet includes a wrapper, a liner assembly, and a trim breaker assembly coupled to the wrapper and the liner assembly. The trim breaker assembly defines a wrapper groove to receive an edge of the wrapper and at least one liner groove to receive at least one edge of the liner assembly. A wrapper light-diffusing optical fiber is disposed in the wrapper groove. The wrapper light-diffusing optical fiber is configured to diffuse light within the wrapper groove. At least one liner light-diffusing optical fiber is disposed in the at least one liner groove. The at least one liner light-diffusing optical fiber is configured to diffuse light within the at least one liner groove. A light reactive adhesive is disposed in the wrapper groove and in the at least one liner groove.

According to another aspect of the present disclosure, a refrigeration appliance includes a trim breaker assembly defining an outside wrapper groove and at least one liner groove. A light reactive adhesive is disposed in the outside wrapper groove and the at least one liner groove. An outside wrapper is disposed within the outside wrapper groove of the trim breaker assembly. At least one liner is disposed within the at least one liner groove of the trim breaker assembly. The at least one liner defines at least one compartment. A wrapper light guide is disposed in the outside wrapper groove. The wrapper light guide is configured to diffuse light within the outside wrapper groove to cure the light reactive adhesive disposed therein. At least one liner light guide is disposed in the at least one liner groove. The at least one liner light guide is configured to diffuse light within the at least one liner groove to cure the light reactive adhesive disposed therein.

According to yet another aspect of the present disclosure, a method for manufacturing a vacuum insulated appliance includes providing a trim breaker assembly defining an outer perimeter and at least one compartment perimeter, the trim breaker assembly defining a wrapper groove extending along the outer perimeter and at least one liner groove extending along the at least one compartment perimeter, positioning a wrapper light-diffusing optical fiber in the wrapper groove, where the wrapper light-diffusing optical fiber is configured to diffuse light within the wrapper groove, and positioning at least one liner light-diffusing optical fiber in the at least one liner groove, where the at least one liner light-diffusing optical fiber is configured to diffuse light within the at least one liner groove. The method further includes injecting an uncured light reactive adhesive in the wrapper groove and the at least one liner groove, positioning an edge of a wrapper within the wrapper groove with the uncured light reactive adhesive, positioning an edge of at least one liner within the at least one liner groove with the uncured light reactive adhesive, and curing the uncured light reactive adhesive in the wrapper groove and the at least one liner groove by diffusing light within the wrapper groove and the at least one liner groove with the wrapper light-diffusing optical fiber and the at least one liner light-diffusing optical fiber, respectively, and at least one light source.

These and other features, advantages, and objects of the present disclosure will be further understood and appreciated by those skilled in the art by reference to the following specification, claims, and appended drawings.

Figure 1:
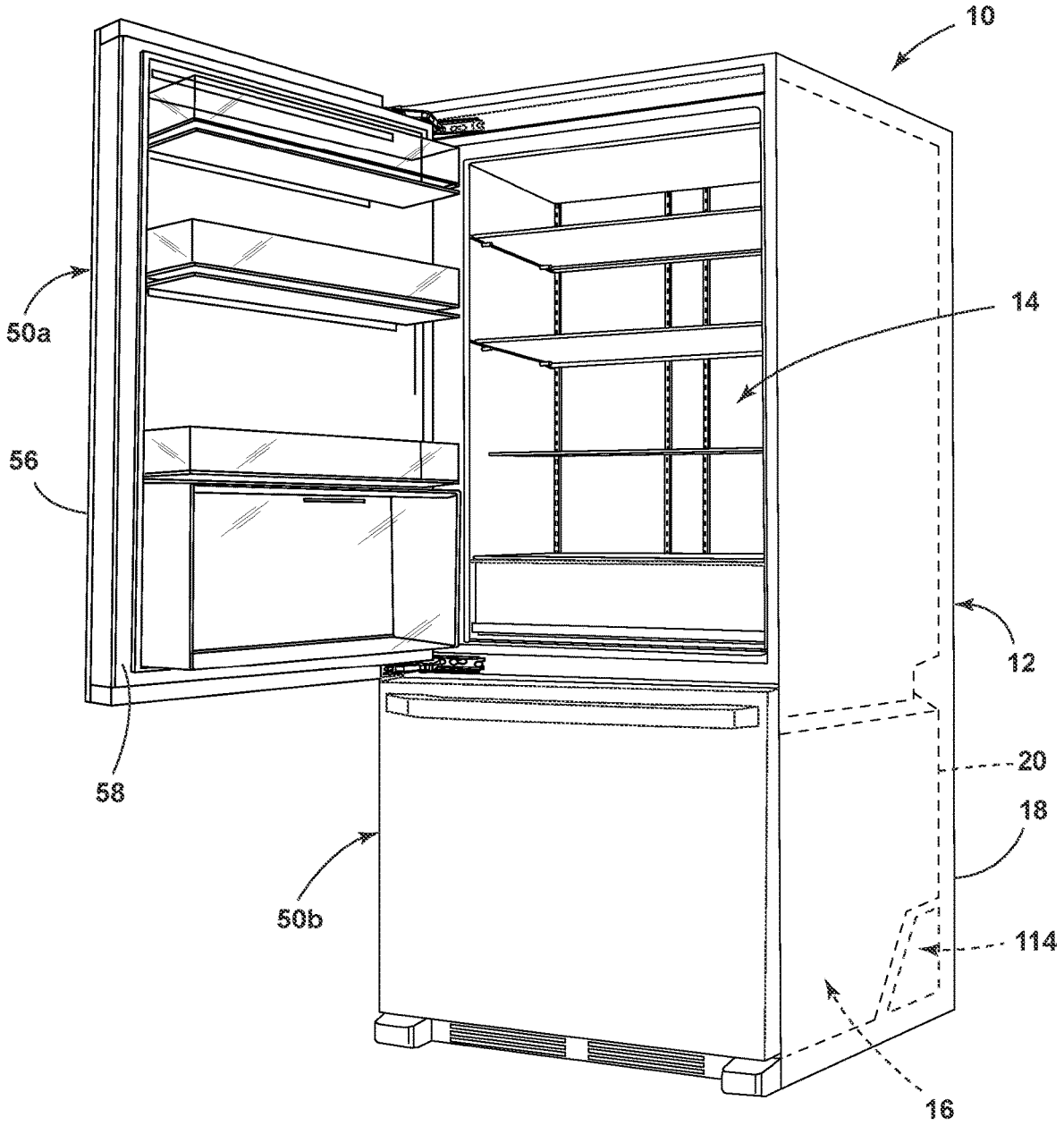
FIG. 1 is a front perspective view of a refrigeration appliance, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a light guide for a trim breaker assembly for an appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-11, reference numeral 10 generally designates a vacuum insulated appliance. The vacuum insulated appliance 10 includes a cabinet 12 defining at least one compartment, often including a refrigerator compartment 14 and a freezer compartment 16. The cabinet 12 includes a wrapper 18, also referred to as an outside wrapper 18, and a liner assembly 20, including at least one liner 20, which often includes a refrigerator liner 20*a* and a freezer liner 20*b*. The cabinet 12 also includes a trim breaker assembly 22 coupled to the wrapper 18 and the liner assembly 20. The trim breaker assembly 22 defines a wrapper groove 24 to receive an edge 26 of the wrapper 18 and at least one or a plurality of liner grooves 28, which may include liner grooves 28*a*, 28*b*, to receive at least one or a plurality of edges 30, which may include edges 30*a*, 30*b*, of the liner assembly 20. A wrapper light guide 32 is disposed in the wrapper groove 24 and configured to diffuse light within the wrapper groove 24. At least one liner light guide 34 or a plurality of liner light guides 34, which may include liner light guides 34*a*, 34*b*, are disposed in the liner grooves 28 and configured to diffuse light within the liner grooves 28. A light reactive or light curing adhesive 36 is disposed in the wrapper groove 24 and the liner grooves 28.

Figure 2:
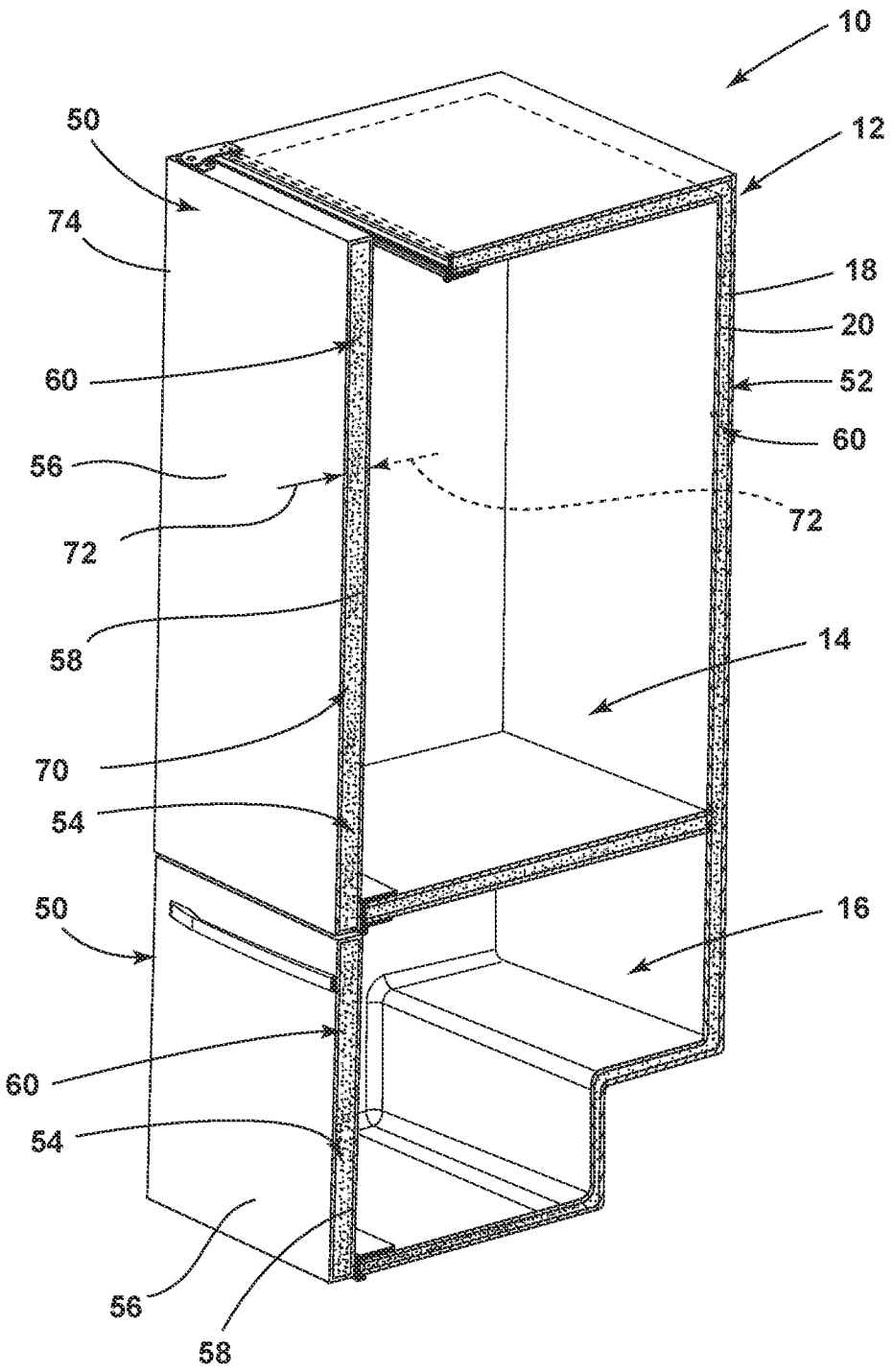
FIG. 2 is a cross-sectional view of a refrigeration appliance with a vacuum insulated cabinet and vacuum insulated doors, according to the present disclosure.

Referring to FIGS. 1 and 2, the vacuum insulated appliance 10 is illustrated as a refrigeration appliance, however, it is contemplated that the vacuum insulated appliance 10 disclosed herein may be for a variety of appliances, structures, panels, or assemblies for insulation purposes other than with an appliance. The refrigeration appliance 10 is illustrated as a bottom-mount refrigerator having an upper compartment configured as the refrigerator compartment 14 and a lower compartment configured as the freezer compartment 16.

The cabinet 12 of the illustrated refrigeration appliance 10 includes a first insulated door 50*a* and a second insulated door 50*b*. The first insulated door 50*a* and the second insulated door 50*b*, which can collectively be referred to as the insulated doors 50, can have substantially similar configurations, as discussed further herein. In this way, the insulated doors 50*a*, 50*b* can seal the refrigerator and freezer compartments 14, 16 defined by the cabinet 12, respectively. Moreover, in various implementations, the appliance 10 may include the cabinet 12 defining at least one compartment, which may include a first compartment, such as the refrigerator compartment 14, and a second compartment, such as the freezer compartment 16, sealed with insulated doors 50. The appliance 10 may be, for example, a bottom-mount French door refrigerator, a top-mount refrigerator, a side-by-side refrigerator, a 4-door French door refrigerator, and/or a 5-door French door refrigerator. Further, the present disclosure is not limited to refrigerators. The appliance 10 may be, for example, freezers, coolers, vacuum insulated structures, and other similar appliances and fixtures within household and commercial settings.

The cabinet 12 of the appliance 10 is an insulated structure having an insulation cavity 52 defined between the wrapper 18 and the liner assembly 20. The wrapper 18 and the liner assembly 20 may collectively be referred to as a structural wrapper that defines the insulation cavity 52. Similarly, the insulated doors 50 are insulated structures each having an insulation cavity 54 defined between a door wrapper 56 coupled to a door liner 58. Each of the insulation cavities 52, 54 of the cabinet 12 and insulated doors 50 typically includes one or more insulation materials 60 disposed therein. It is generally contemplated that the insulation materials 60 may be glass-type materials, carbon-based powders, silicon oxide-based materials, silica-based materials, insulating gasses, and other standard insulation materials 60 known in the art.

The insulation materials 60 substantially fill the insulation cavity 52, forming a substantially continuous layer between the wrapper 18 and the liner assembly 20. Similarly, the insulation materials 60 substantially fill the insulation cavity 54, forming a substantially continuous layer between the door wrapper 56 and the door liner 58, for one or both doors 50. The insulation cavities 52, 54 are filled with the insulation materials 60 using a load port on the cabinet 12 and the insulated doors 50, respectively. The cabinet 12 and the insulated doors 50 each define an evacuation port for applying a vacuum or negative pressure 70 to the insulation cavities 52, 54.

Figure 3:
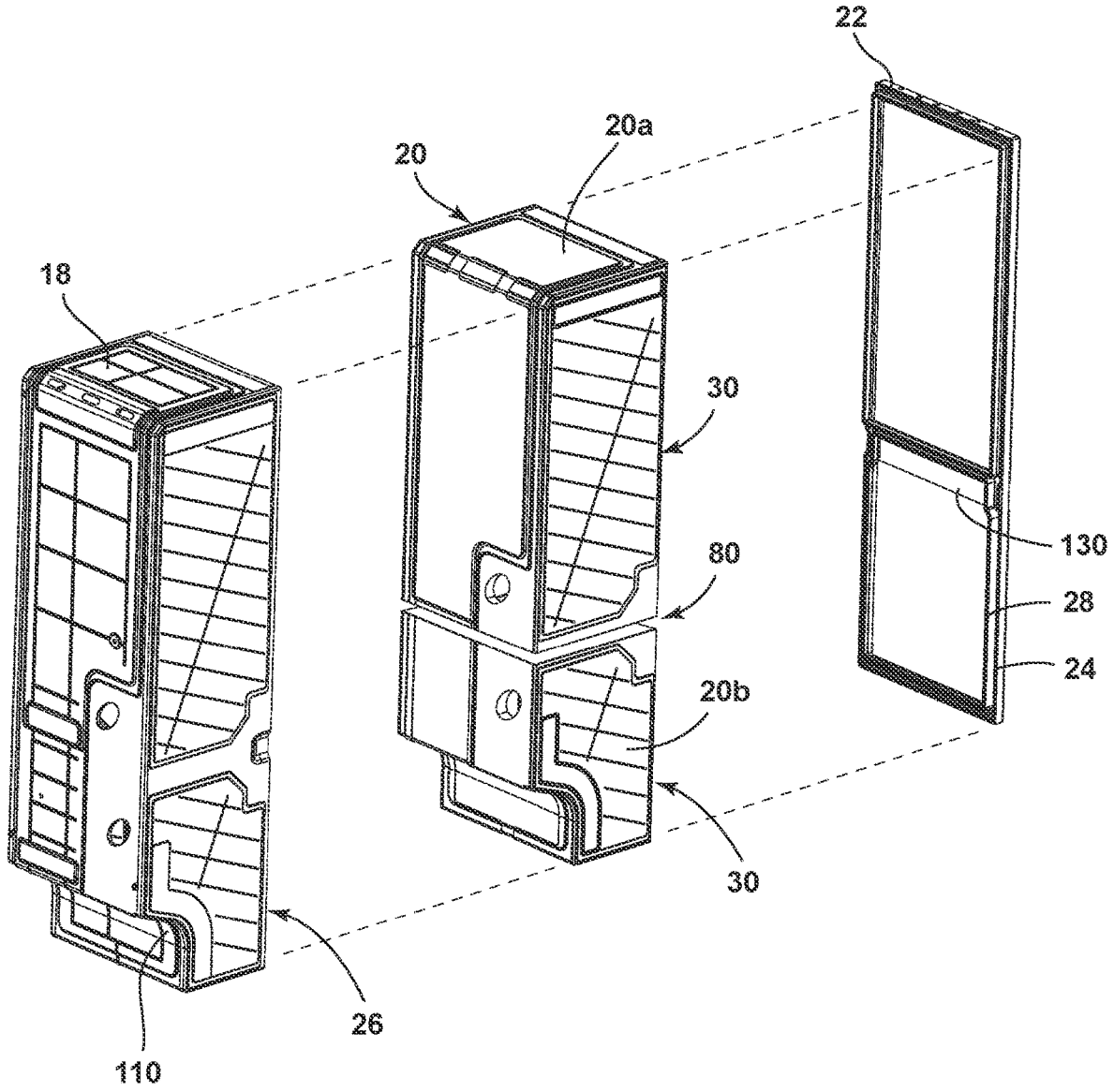
FIG. 3 is an exploded side perspective view of a cabinet for a refrigeration appliance with a wrapper, a liner assembly, and a trim breaker assembly, according to the present disclosure.

Referring still to FIGS. 1-3, an at least partial vacuum 70 is defined within the insulation cavities 52, 54, forming the cabinet 12 and the doors 50 as vacuum insulated structures. The at least partial vacuum 70 defines a pressure differential 72 between an exterior 74 of the cabinet 12 and the insulation cavity 52. The pressure differential 72 serves to define the inward compressive force that is exerted on both the wrapper 18 and the liner assembly 20 and tends to bias the wrapper 18 and the liner assembly 20 toward the insulation cavity 52. The pressure differential 72 and the inward compressive force are also exerted on both the door wrappers 56 and the door liners 58 of the insulated doors 50 and tend to bias the door wrappers 56 and the door liners 58 towards the insulation cavity 54, respectively, in a similar manner.

The wrapper 18, the door wrapper 56, the liner assembly 20, and the door liner 58 are made from a material at least partially resistant to bending, deformation, or otherwise being deformed in response to an inward compressive force. These materials for the wrapper 18, the door wrapper 56, the liner assembly 20, and the door liner 58 include, but are not limited to, metals, polymers, metal alloys, combinations thereof, and/or other similar substantially rigid materials that can be used for vacuum insulated appliances and structures.

Referring to FIG. 3, the liner assembly 20 may include the refrigerator liner 20*a* to define the refrigerator compartment 14 and the freezer liner 20*b* to define the freezer compartment 16. The refrigerator liner 20*a* and the freezer liner 20*b* may also be separate components defining a mullion gap 80 in the insulation cavity 52 therebetween when coupled together. The mullion gap 80 may be filled with the insulation materials 60 and be placed under the at least partial vacuum 70. The refrigerator liner 20*a* and the freezer liner 20*b* may be biased toward the mullion gap 80 in the insulation cavity 52, in a similar manner to that discussed with reference to the wrapper 18 and the liner assembly 20 generally.

In various implementations, the refrigerator liner 20*a* and the freezer liner 20*b* may be coupled together in the mullion gap 80 separate from the trim breaker assembly 22. The refrigerator liner 20*a* and the freezer liner 20*b* may still define the mullion gap 80 when coupled together. While the liner assembly 20 is shown as having two separate liners 20*a*, 20*b*, the liner assembly 20 may be a single portion or structure defining the refrigerator and freezer compartments 14, 16. The liner assembly 20 may also be a single structure defining the refrigerator compartment 14 or the freezer compartment 16. The liner assembly 20 can generally have a similar shape as the wrapper 18 to fit within the wrapper 18 and form the cabinet 12.

Figure 4:
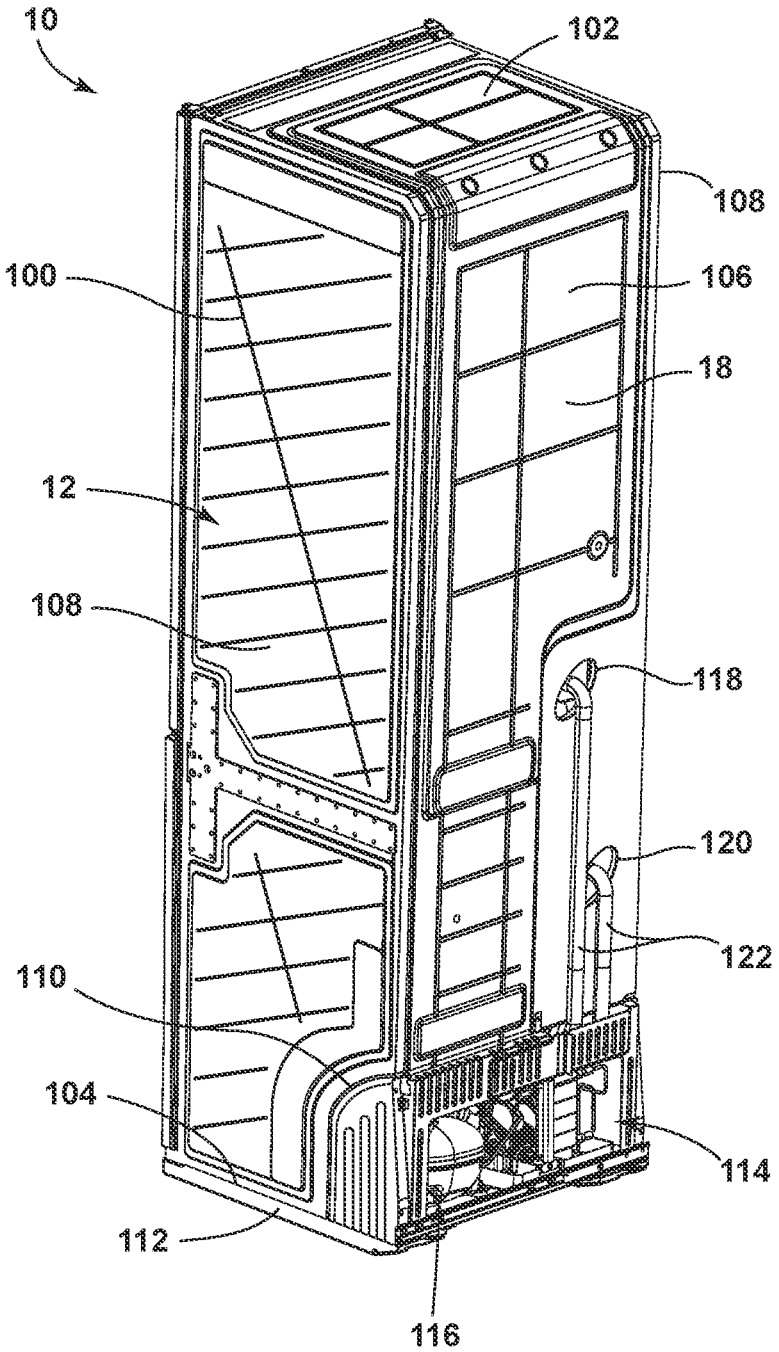
FIG. 4 is a side perspective view of a refrigeration appliance, according to the present disclosure.

Referring still to FIG. 3, as well as FIG. 4, the wrapper 18 has a plurality of walls 100, which may include a top wall 102, a bottom wall 104, a rear wall 106, a pair of side walls 108, and a curved wall 110. The bottom wall 104 of the wrapper 18 may be coupled to a base 112. The curved wall 110 of the wrapper 18 and the base 112 at least partially defines a mechanical compartment 114. Various appliance components 116 can be positioned on the base 112 within the mechanical compartment 114 below the rear wall 106 and proximate to the curved wall 110 of the wrapper 18. The appliance components 116 positioned within the mechanical compartment 114 may include components of a refrigerant system, which may include a compressor, a condenser, and/or portions of an evaporator assembly. The appliance components 116 may also include a controller, electronics, or other components for operation of the appliance 10.

The wrapper 18 and the liner assembly 20 may define a first passthrough 118 and a second passthrough 120 to provide a passage for service connections 122. The wrapper 18 and the liner assembly 20 each define apertures that align with one another to form the first and second passthroughs 118, 120. The service connections 122 may be electrical, fluid, refrigerant system, and/or other appliance connections between the refrigerator and freezer compartments 14, 16 and an outside 124 of the cabinet 12. For example, the service connections 122 may include a suction tube, a drain tube, and a wiring harness.

Figure 5:
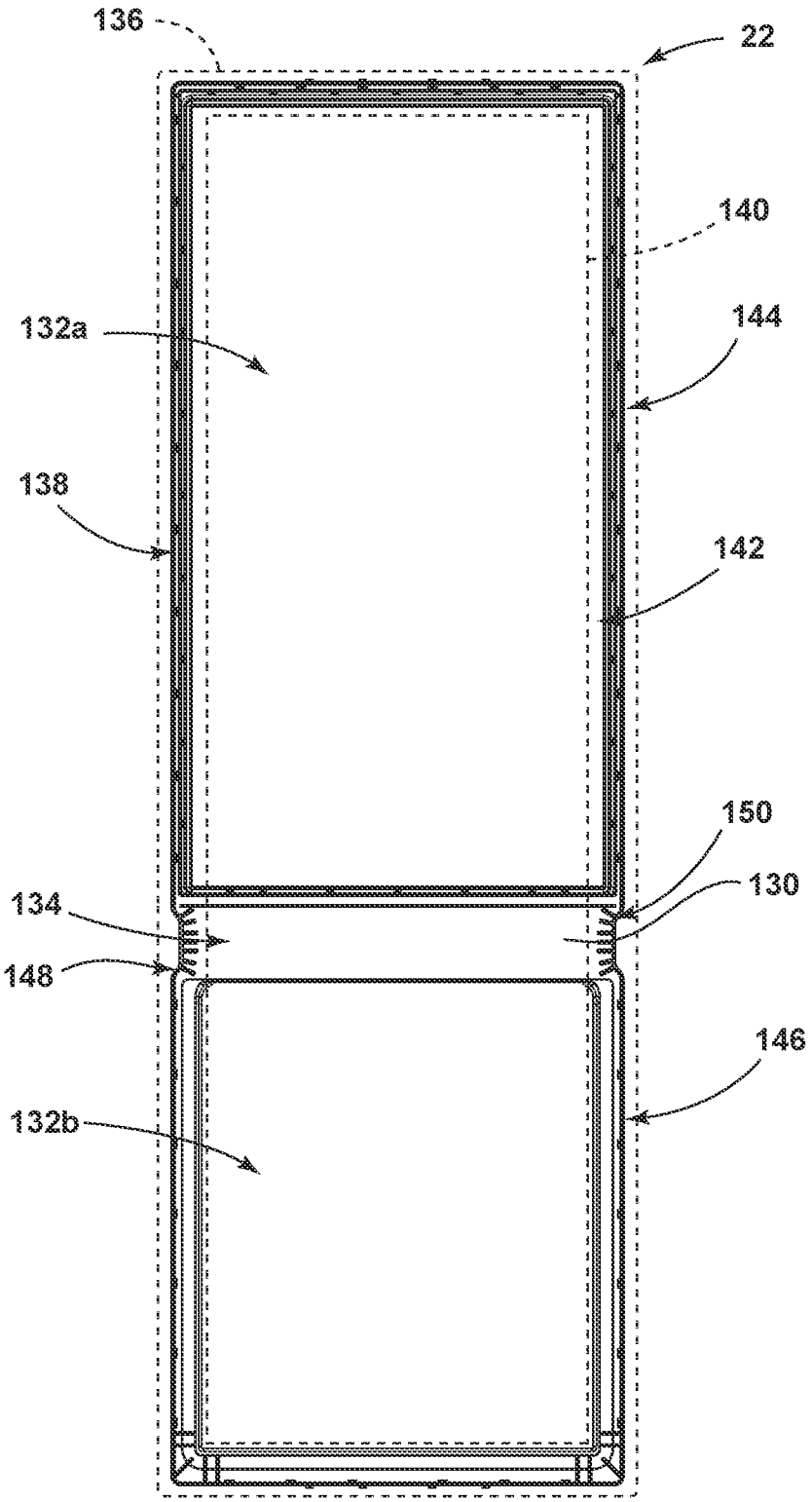
FIG. 5 is a front elevational view of the trim breaker of FIG. 3, according to the present disclosure.
Figure 6:
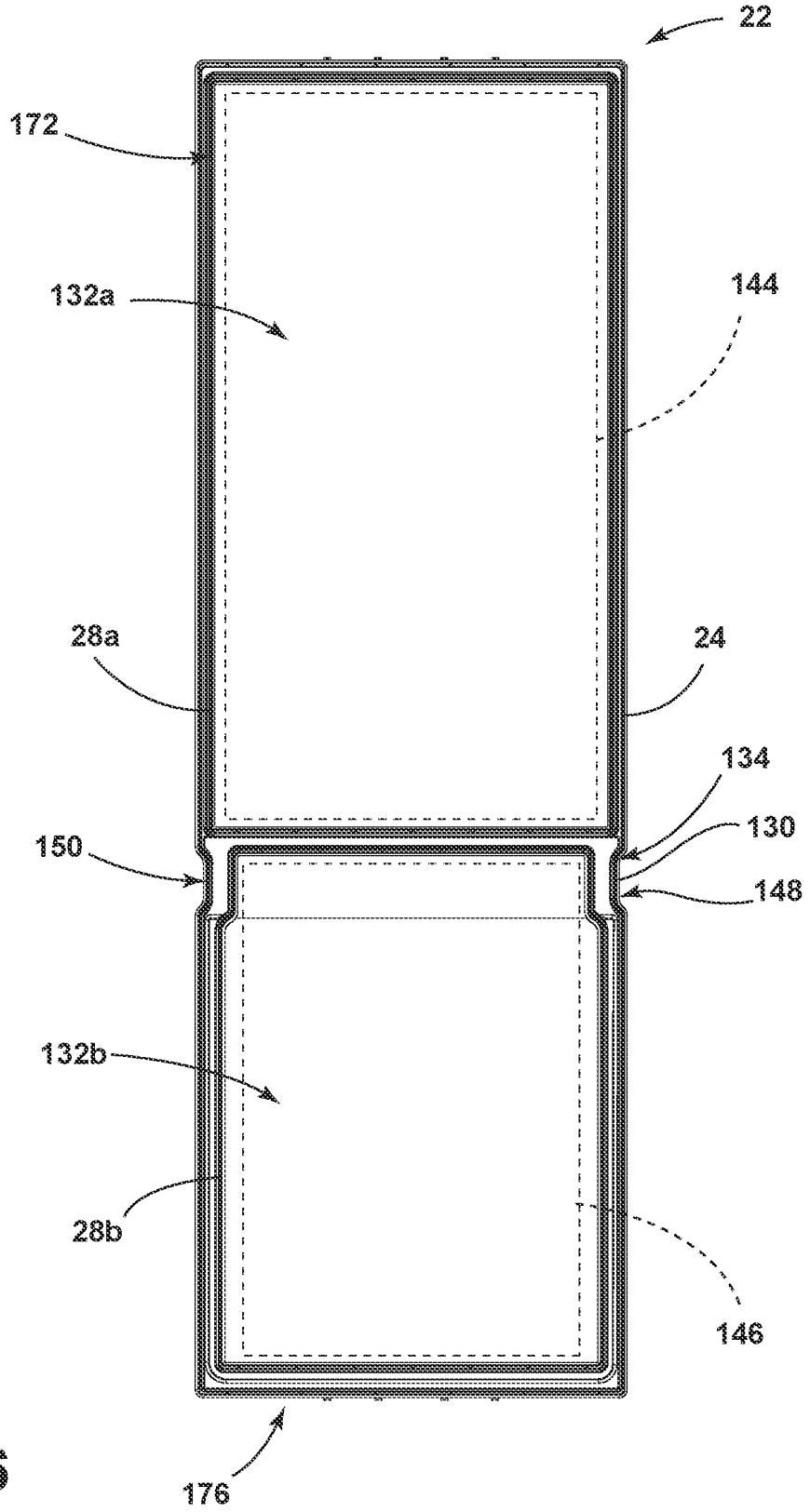
FIG. 6 is a rear elevational view of the trim breaker of FIG. 3, according to the present disclosure.

Referring still to FIG. 3, as well as FIGS. 5 and 6, the trim breaker assembly 22 generally couples the wrapper 18 to the liner assembly 20 to form the cabinet 12. It is contemplated that the trim breaker assembly 22 may be coupled to the edge 26 of the wrapper 18 and/or the edge 30 of the liner assembly 20. The trim breaker assembly 22 has a generally rectangular shape, however, it is contemplated that other geometric shapes known in the art may be used. In this way, the trim breaker assembly 22 may not substantially interfere with access to the refrigerator and freezer compartments 14, 16 defined by the cabinet 12.

The trim breaker assembly 22 may include a cross member 130 to define apertures 132*a*, 132*b* corresponding to the refrigerator and freezer compartments 14, 16 of the appliance 10, respectively. The cross member 130 defines a mullion region 134 between the refrigerator and freezer compartments 14, 16. The trim breaker assembly 22 generally defines an outer perimeter 136 extending along an outer portion 138 of the trim breaker assembly 22 and an inner perimeter 140 extending along an inner portion 142 of the trim breaker assembly 22. The inner perimeter 140 may be concentric and extend parallel with the outer perimeter 138. The inner perimeter 140 generally extends around both the apertures 132*a*, 132*b* corresponding to the compartments 14, 16. In the illustrated example, the inner perimeter 140 of the trim breaker assembly 22 includes a portion of a perimeter 144 of the refrigerator compartment 14 around the upper aperture 132*a* and a portion of a perimeter 146 of the freezer compartment 16 around the lower aperture 132*b*. Additional portions of the perimeters 144, 146 of the compartments 14, 16 extend across the cross member 130. These portions of the perimeters 144, 146 may extend parallel to each other across the cross member 130. In this way, the perimeters 144, 146 define openings into the compartments 14, 16, respectively.

The perimeter 144 of the refrigerator compartment 14 may be a portion of the inner perimeter 140, extending around the upper aperture 132*a* from a first end 148 of the mullion region 134 to a second end 150 of the mullion region 134 and along the cross member 130 from the second end 150 of the mullion region 134 to the first end 148. Similarly, the perimeter 146 of the freezer compartment 16 may be a portion the inner perimeter 140, extending around the lower aperture 132*b* from the first end 148 of the mullion region 134 to the second end 150 and along the cross member 130 from the second end 150 of the mullion region 134 to the first end 148. It is contemplated that the inner perimeter 140 may extend around one aperture 132*a* or 132*b* in implementations where the appliance 10 includes one compartment 14 or 16.

Referring still to FIGS. 3, 5, and 6, the trim breaker assembly 22 defines the wrapper groove 24 and the liner grooves 28 to receive the edge 26 of the wrapper 18 and the edge 30 of the liner assembly 20, respectively. The wrapper groove 24 may extend along the outer perimeter 136 of the trim breaker assembly 22. The trim breaker assembly 22 may include a single liner groove 28 extending along the inner perimeter 140 of the trim breaker assembly 22 or may include multiple liner grooves 28 extending along the perimeters 144, 146 of the compartments 14, 16. It is contemplated that the trim breaker assembly 22 may define a single combined groove that extends along the outer perimeter 136 to accommodate both the wrapper 18 and the liner assembly 20 therein.

In the illustrated example, the refrigerator liner groove 28*a* extends along the perimeter 144 of the refrigerator compartment 14 to receive the refrigerator liner 20*a*, and the freezer liner groove 28*b* extends along the perimeter 146 of the freezer compartment 16 to receive the freezer liner 20*b*. Stated differently, the refrigerator liner groove 28*a* extends along the inner perimeter 140 around the upper aperture 132*a* from the first end 148 of the mullion region 134 to the second end 150 of the mullion region 134, and along the cross member 130 from the second end 150 of the mullion region 134 to the first end 148. The freezer liner groove 28*b* extends along the inner perimeter 140 around the lower aperture 132*b* from the first end 148 of the mullion region 134 to the second end 150, and along the cross member 130 from the second end 150 of the mullion region 134 to the first end 148. In various implementations, the liner groove 28 may be a single groove 28 that accommodates both the refrigerator liner 20*a* and the freezer liner 20*b* of the liner assembly 20.

Referring still to FIGS. 5 and 6, and now also FIGS. 7A-10B, the trim breaker assembly 22 may include multiple cross-sectional profiles at different locations, including a first cross-sectional profile 170 along a portion 172 of the perimeter 144 of the refrigerator compartment 14 and a second cross-sectional profile 174 along a portion 176 of the perimeter 146 of the freezer compartment 16. The cross member 130 may be the first cross-sectional profile 170, the second cross-sectional profile 174, and/or another, third cross-sectional profile. The first cross-sectional profile 170 and the second cross-sectional profile 174 may each define the wrapper groove 24 and the respective liner groove 28.

The wrapper groove 24 in the first cross-sectional profile 170 may align with the wrapper groove 24 in the second cross-sectional profile 174, thereby forming a continuous wrapper groove 24 around the outer perimeter 136 of the trim breaker assembly 22. In some implementations, the liner groove 28*a* defined by the first cross-sectional profile 170 may align with the liner groove 28*b* defined by the second cross-sectional profile 174 to form a continuous liner groove 28 around the inner perimeter 140 of the trim breaker assembly 22. In the illustrated example, the liner groove 28*a* defined by the first cross-sectional profile 170 aligns with the liner groove 28*a* defined by the cross member 130, forming the liner groove 28*a* extending around the perimeter 144 of the refrigerator compartment 14. Similarly, the liner groove 28*b* defined by the second cross-sectional profile 174 aligns with the liner groove 28*b* defined by the cross member 130, forming the liner groove 28*b* extending around the perimeter 146 of the freezer compartment 16.

Referring still to FIGS. 7A, 8A, 9A, and 10A, the first cross-sectional profile 170 of the trim breaker assembly 22 includes an outside wall 180 that extends generally parallel to and away from the wrapper 18 when coupled thereto. A wrapper groove wall 182 is coupled or connected to the outside wall 180. The wrapper groove wall 182 extends away from and then parallel to the outside wall 180 to define the wrapper groove 24 therebetween. An inner wall 184 is coupled or connected to the wrapper groove wall 182 and extends to a liner groove wall 186 that defines the liner groove 28*a*. The liner groove 28*a* may be offset or recessed from the wrapper groove 24.

Referring again to FIGS. 7B, 8B, 9B, and 10B, the second cross-sectional profile 174 of the trim breaker assembly 22 includes an outside wall 190 that extends generally parallel to and away from the wrapper 18 when coupled thereto. A wrapper groove wall 192 is coupled or connected to the outside wall 190. The wrapper groove wall 192 extends away from and then parallel to the outside wall 190 to define the wrapper groove 24 therebetween. An inner wall 194 is coupled or connected to the wrapper groove wall 192 and extends to a liner groove wall 196 that defines the liner groove 28*b*. The liner groove 28*b* may be offset or recessed from the wrapper groove 24.

In some implementations, the trim breaker assembly 22 may have the first cross-sectional profile 170 or the second cross-sectional profile 174 around each of the compartments 14, 16. The first cross-sectional profile 170 and second cross-sectional profile 174 are not limited to the configurations described herein. The first cross-sectional profile 170 and second cross-sectional profile 174 may also be configured to include the single combined groove to accommodate both the wrapper 18 and the liner assembly 20.

Referring again to FIGS. 7A-10B, the wrapper light guide 32 and the liner light guides 34 are disposed in the wrapper groove 24 and the liner grooves 28, respectively. The light guides 32, 34 are generally configured to diffuse or disperse light within the respective grooves 24, 28 to cure the light reactive adhesive disposed therein. Accordingly, the light guides 32, 34 are configured to allow light to be emitted along a length of the light guides 32, 34 to diffuse or disperse light along a substantial portion or entirety of the wrapper groove 24 and the liner grooves 28, respectively. This configuration may provide for more even or consistent diffusion or dispersion of light to more uniformly cure the adhesive 36.

The light guides 32, 34 are generally constructed from an optically clear or substantially clear material to allow for light to travel a length of the light guides 32, 34 and also be diffused. The light guides 32, 34 may consist of varied materials having different transparency allowing for different or varied levels of light intensity and diffusing along the length of the light guides 32, 34. The light guides 32, 34 may be constructed of glass, glass ceramics, plastics, or other materials allowing for light to travel and be diffused along the length of the light guide 32, 34. In some implementations, the light guides 32, 34 may be light-diffusing optical fibers, diffuse optical fibers, diffused optical fibers, or other optical fibers or light guides configured to diffuse the light within the grooves 24, 28.

The light guides 32, 34 may be configured to couple to a light source 200. The light source 200 is generally configured to emit light into the light guides 32, 34, whereby the light travels along the length of the light guides 32, 34 to be diffused along the lengths thereof. The light source 200 may emit visible light having a wavelength between about 380 nanometers (nm) and about 700 nm to cure the light reactive adhesive 36. The light source 200 may emit ultraviolet light having a wavelength between about 100 nm and about 400 nm or other non-visible light to cure the light reactive adhesive 36.

The light source 200 may also be configured to have an intensity or brightness that can be adjusted or controlled manually or automatically. For example, the light source 200 may be configured to automatically adjust the intensity of the emitted light based on a set procedure or program. The light source 200 may also be configured to allow for automatic or manual adjustment of the wavelength of light being emitted, which may include allowing for the light source 200 to emit both visible light and non-visible light (e.g., ultraviolet light). By controlling the intensity or wavelength of the light emitted by the light source 200, the curing of the light reactive adhesive 36 may be controlled.

The light guides 32, 34 may include ends 202 configured to be coupled to the light source 200. The ends 202 may include connectors 204 configured to be selectively coupled to the light source 200. The connectors 204 may include snap-in connectors, ferrule core (FC) connectors, mechanical transfer registered jack (MT-RJ) connectors, lucent connectors (LC), plastic fiber optic cable connectors, threaded connectors, jack connectors, or other connectors allowing for the light guides 32, 34 to be coupled to the light source 200 and have light injected or directed therein.

The light guides 32, 34 may be disposed in an inner portion 212 of the respective grooves 24, 28. The wrapper light guide 32 may be routed along a portion of the outer perimeter 136 or the full outer perimeter 136 in the wrapper groove 24. The end 202 of the wrapper light guide 32 may be routed from the wrapper groove 24, along an inner surface 214 of the wrapper groove 24, and to an outside 216 of the trim breaker assembly 22. Stated differently, when the trim breaker assembly 22 is coupled with the wrapper 18, the end 202 of the wrapper light guide 32 may be routed from the inner portion 212 of the wrapper groove 24, along an outside surface 218 of the wrapper 18, to the outside 124 of the cabinet 12.

The liner light guides 34 may be routed along a portion of the inner perimeter 140 or the full inner perimeter 140 in the liner grooves 28. The ends 202 of the liner light guides 34 may be routed from the liner grooves 28, along an inner surface 220 of the liner grooves 28, and to an aperture interior 222 of the trim breaker assembly 22. Stated differently, when the trim breaker assembly 22 is coupled with the liner assembly 20, the ends 202 of the liner light guides 34 may be routed from the inner portion 212 of the liner grooves 28, along a compartment surface 224 of the liner assembly 20 to an interior 226 of the compartment 14 and/or the compartment 16.

In the illustrated example, the refrigerator light guide 34*a* is disposed in the refrigerator liner groove 28*a* and routed along the perimeter 144 of the refrigerator compartment 14, and the freezer light guide 34*b* is disposed in the freezer liner groove 28*b* and routed along the perimeter 146 of the freezer compartment 16. The light guides 34*a*, 34*b* may be routed along a portion or an entirety of the perimeters 144, 146 of the respective compartments 14, 16. The end 202 of the refrigerator light guide 34*a* may be routed from the inner portion 212 of the refrigerator liner groove 28*a*, along the compartment surface 224 of the refrigerator liner 20*a*, to the interior 226 of the refrigerator compartment 14. Similarly, the end 202 of the freezer light guide 34*b* may be routed from the inner portion 212 of the freezer liner groove 28*b*, along the compartment surface 224 of the freezer liner 20*b*, to the interior 226 of the freezer compartment 16.

The wrapper light guide 32 and the liner light guides 34 are not limited to such configurations and may be disposed within the respective grooves 24, 28 to diffuse light within each of the wrapper groove 24 and the liner grooves 28. For example, each of the grooves 24, 28 may include multiple light guides 32, 34 disposed therein. The multiple light guides 32, 34 may extend along the full length of the grooves 24, 28. Each of the multiple light guides 32, 34 may also extend a portion of the full length of the grooves 24, 28, thereby effectively having a single light guide 32, 34 at each discrete portion of the grooves 24, 28 while having multiple disposed therein.

The light guides 32, 34 may be configured to emit light within a portion, portions, intervals, or an entirety of the grooves 24, 28. The lights guides 32, 34 may also be configured to emit varied intensity or brightness of light within portions of the grooves 24, 28. For example, the light guides 32, 34 may be configured to emit higher intensity light away from the inner portions 212 of the grooves 24, 28 and less intense light toward the inner portions 212. This may assist with more even curing of the adhesive if there is a lower proportion of the adhesive toward the inner portions 212 of the grooves 24, 28 (e.g., between the trim breaker assembly 22 and the light guides 32, 34) than away from the inner portions 212 (e.g., between the light guides 32, 34 and the outside 216 of the trim breaker assembly 22). The light guides 32, 34 may also be configured to emit no or minimal light toward the inner portions 212. This configuration may be advantageous when the light guides 32, 34 abut the inner portions 212 of the trim breaker assembly 22.

The wrapper light guide 28 may also be configured to emit light around a portion, portions, intervals or an entirety of the outer perimeter 136. The wrapper light guide 28 may also be configured to emit varied intensity of light around the outer perimeter 136. The liner light guides 34*a*, 34*b* may be configured to emit light around a portion, portions, intervals, or an entirety of the perimeters 144, 146 of the respective compartments 14, 16. The liner light guides 32, 34 may also be configured to emit varied intensity of light around the perimeters 144, 146 of the respective compartments 14, 16. For example, the light guide 34*a*, 34*b* may be configured to be emit less intense light or no light along the portion of the light guides 34*a* 34*b* extending along the grooves 28*a*, 28*b* defined by the cross member 130.

Referring again to FIGS. 8A-8B, the light reactive adhesive 36 may be dispensed or disposed in the wrapper groove 24 and the liner grooves 28 using an adhesive nozzle 240 configured to be adjusted around the perimeters 144, 146 of the compartments 14, 16 and/or the outer perimeter 136 of the trim breaker assembly 22. The adhesive nozzle 240 may be coupled to a linear robot or other machines that are configured to move the adhesive nozzle 240 along a defined path. The adhesive nozzle 240 may be moved or routed along the defined path to dispense and at least partially fill the grooves 24, 28 with the light reactive adhesive 36 over the light guides 32, 34. The adhesive nozzle 240 is not limited to adjustment by machines or robots and may be adjusted manually by a user or operator. For example, the adhesive nozzle 240 may be coupled to a handheld dispenser adjusted by the user.

The light reactive adhesive 36 is generally dispensed in an uncured state and undergoes a curing process that results in a cured state. In the uncured state, the adhesive 36 may be a liquid, a fluid, or a semi-solid where the adhesive 36 may be directed to specific locations in the grooves 24, 28 through the adhesive nozzle 240. In the uncured state, the adhesive 36 has not undergone the curing process or at least an entirety of the curing process as it is dispensed by the adhesive nozzle 240. In some implementations, the adhesive 36 may begin to undergo the curing process in the adhesive nozzle 240 or while being dispensed therefrom.

The curing process for the light reactive adhesive 36 is generally an activated curing process that is initiated by being introduced to light (e.g., ultraviolet light). Thus, the light reactive adhesive 36 generally includes a photoinitiator to catalyze or activate a chemical reaction to cure the adhesive 36. The photoinitiator generally reacts with the light provided by the light source 200 or other secondary light sources to initiate the chemical reaction by creating free radicals. The photoinitiator may interact with visible light having a wavelength between about 380 nm and about 700 nm, ultraviolet light having a wavelength between about 100 nm and about 400 nm, and/or other non-visible light.

In addition to the photoinitiator, the curing process of the adhesive 36 may be activated or initiated through various other means. For example, the adhesive 36 may also begin to undergo the curing process once introduced to an atmosphere together. The adhesive 36 may also be a multi-part mix where the curing process begins when components are mixed together, causing a chemical reaction to begin. Even when the adhesive 36 begins the curing process by means other than introducing light, the curing process may be catalyzed by further activation of the photoinitiator by introducing light.

In various implementations, the curing process may be active while the light is introduced to the adhesive 36 and stops once the light is removed from the adhesive 36. In such implementations, the intensity and activation of light may be controlled to regulate the rate and progression of the curing process for the adhesive 36. For example, the light source 200 may emit light into the light guides 32, 34 for a period of time to begin the curing process, which may change a physical characteristics of the adhesive 36. The adhesive 36 may maintain the physical characteristic after the light is deactivated until the light source 200 is reactivated. The rate of the curing process of the adhesive 36 may also be controlled by varying the intensity or the wavelength of the light from the light source 200. The photoinitiator may interact with various wavelengths of light at different rates, which allows for the control of the rate of curing. Similarly, when more or less light is provided to the photoinitiator within the adhesive 36, the rate at which the interactions of light and the photoinitiator occur may be controlled. By controlling the physical characteristics and the rate of the curing process of the adhesive 36 disposed in the grooves 24, 28, manufacturing efficiency may be improved.

In other implementations, the adhesive 36 may begin the curing process once the light is introduced to the adhesive 36, and the curing process continues to the cured state regardless of whether the adhesive 36 is exposed to the light through the entire curing process. The light-catalyzed curing process of the adhesive 36 generally provides for short or shortened curing times of the adhesive 36, which in turn may increase the efficiency of a manufacturing process of the cabinet 12. The intensity and activation of light may be controlled to regulate the rate of the curing process of the adhesive 36. For example, the adhesive 36 may have a slow rate of curing when not exposed to light relative to the rate when exposed to light. The rate of the curing process can be controlled by modulating the light source 200 between emitting and not emitting light, varying the intensity of light emitted, and/or varying the wavelength of the light being emitted, as discussed herein.

During the curing process, the adhesive 36 may adhere to the trim breaker assembly 22, the wrapper 18, and/or the liner assembly 20. The adhesive 36 may chemically react with the trim breaker assembly 22, the wrapper 18, and/or the liner assembly 20, creating a chemical bond, and/or the adhesive 36 may mechanically couple to the trim breaker assembly 22, the wrapper 18, and/or the liner assembly 20. The adhesive 36 generally cures to a solid or semi-solid state to couple the wrapper 18 and/or liner assembly 20 to the trim breaker assembly 22 and generally maintains the position of the components of the cabinet 12. The adhesive 36 in the cured state may be an air barrier between the insulation cavity 52 and the outside 124 of the cabinet 12. The adhesive 36 in the cured state may be air impermeable or substantially air impermeable to allow for the insulation cavity 52 to maintain the at least partial vacuum 70 therein. The adhesive 36 may also cure to resist or substantially resist the pressure differential 72 between the insulation cavity 52 and the outside 124 of the cabinet 12.

The light reactive adhesive 36 may be a structural adhesive to couple the trim breaker assembly 22 to the wrapper 18 and/or the liner assembly 20. Structural adhesives generally cure to form bonds that can bear a structural load. The light reactive adhesive 36 generally includes a monomer and the photoinitiator and may also include an oligomer and additional additives (e.g., stabilizers, pigments, inhibitors, etc.) in the uncured state.

In non-limiting examples, the adhesive 36 may be an epoxy adhesive. The epoxy adhesive 36 may be a one-part epoxy including the photoinitiator or a two-part epoxy including the photoinitiator. In such examples, the monomer includes a free epoxide group that reacts with the free radical from the photoinitiator to form a polymeric chain during the curing process. The two-part epoxy may begin the curing process upon the two parts being mixed together, which may be catalyzed by the free radical produced by the interaction of the photoinitiator with light. However, the adhesive 36 is not limited to such examples and may be acrylic adhesives, urethane acrylate ester adhesives, urethane adhesives, other adhesives, and/or combinations thereof that cure to adhere the trim breaker assembly 22 to the wrapper 18 and/or the liner assembly 20 and prevent or reduce air infiltration therethrough.

Figure 9A:
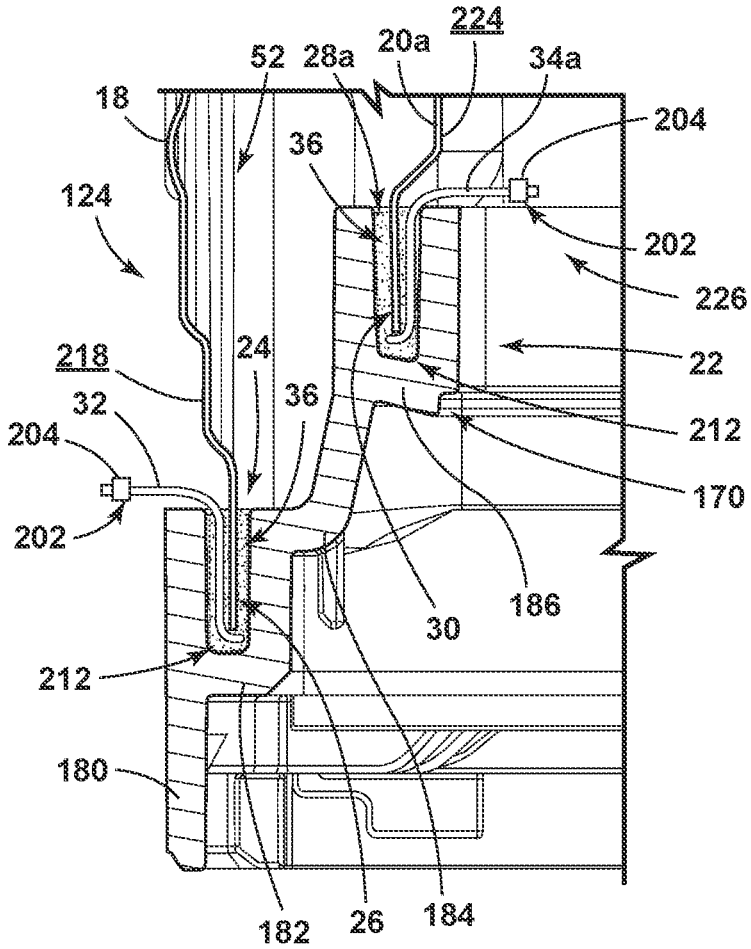
FIG. 9A is a partial cross-sectional view of a cabinet of a refrigeration appliance, illustrating a trim breaker assembly having light guides and an adhesive disposed in grooves and coupled to a wrapper and a liner assembly, according to the present disclosure.
Figure 9B:
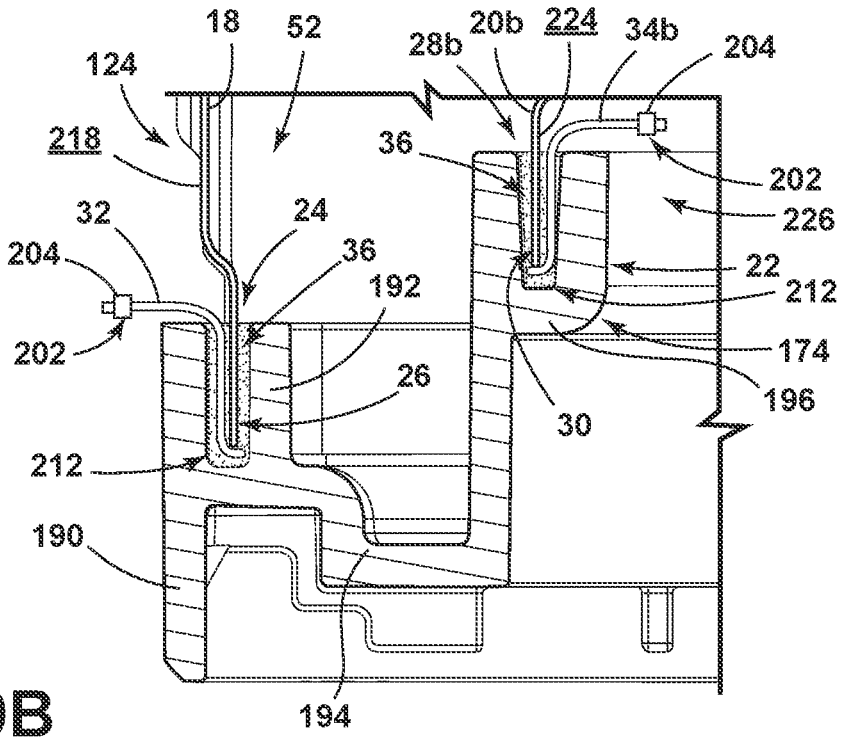
FIG. 9B is a partial cross-sectional view of a cabinet of a refrigeration appliance, illustrating a trim breaker assembly having light guides and an adhesive disposed in grooves and coupled to a wrapper and a liner assembly, according to the present disclosure.
Figure 10A:
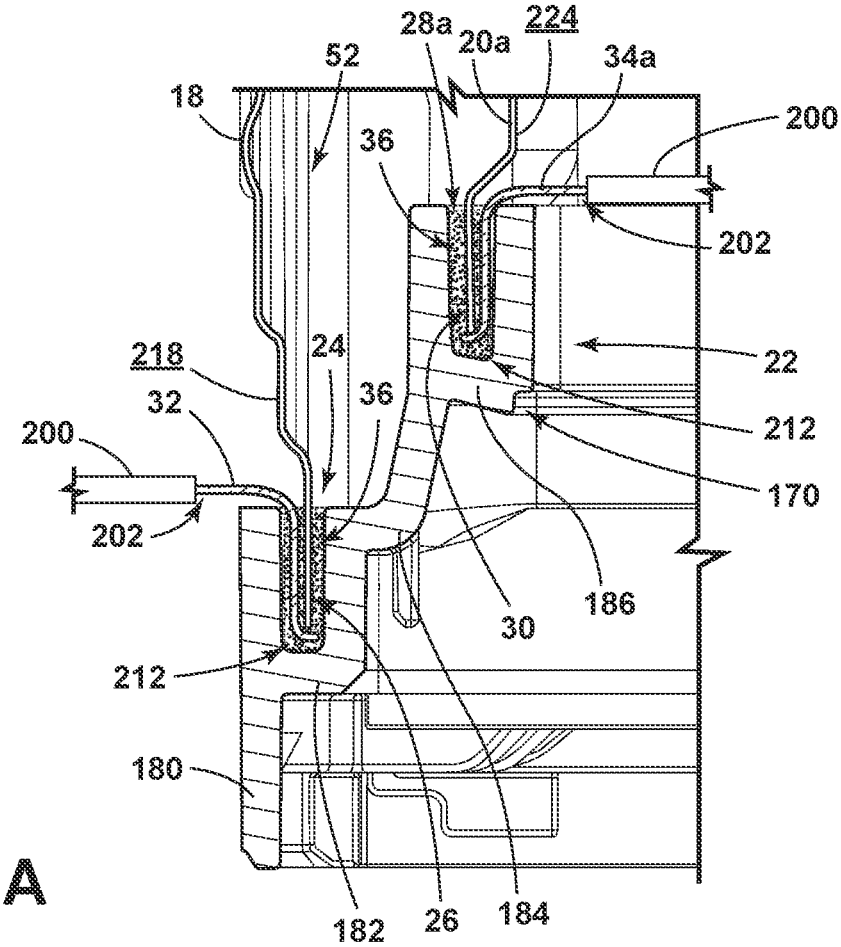
FIG. 10A is a partial cross-sectional view of a cabinet of a refrigeration appliance, illustrating a trim breaker assembly having light guides coupled to light sources and adhesive disposed in grooves with the trim breaker assembly coupled to a wrapper and a liner assembly, according to the present disclosure.
Figure 10B:
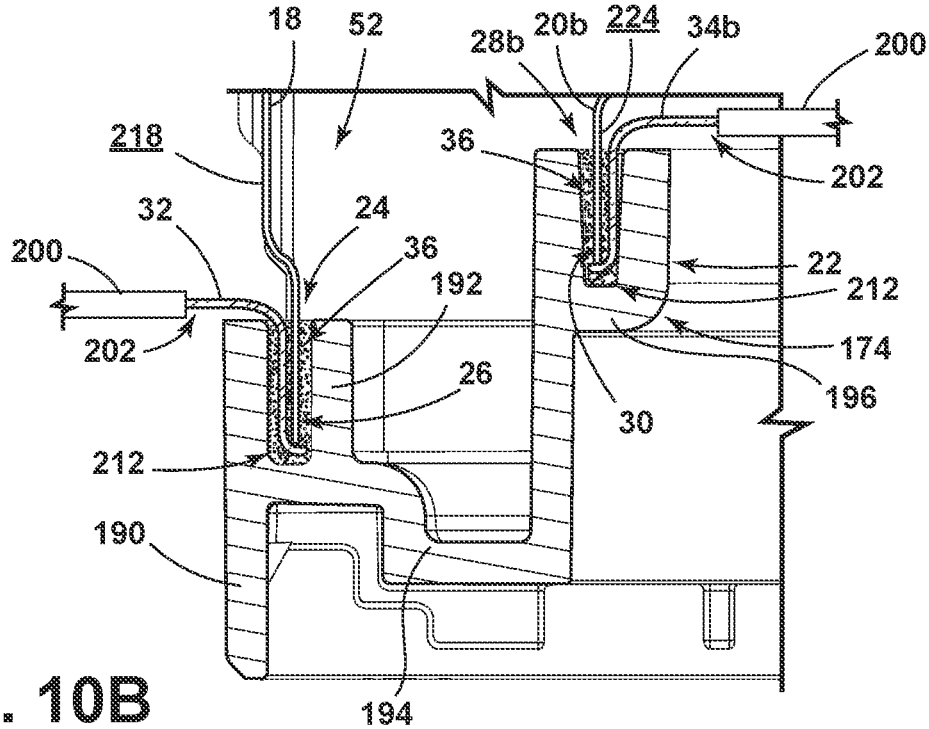
FIG. 10B is a partial cross-sectional view of a cabinet of a refrigeration appliance, illustrating a trim breaker assembly having light guides coupled to light sources and an adhesive disposed in grooves with the trim breaker assembly coupled to a wrapper and a liner assembly, according to the present disclosure.
Figure 11:
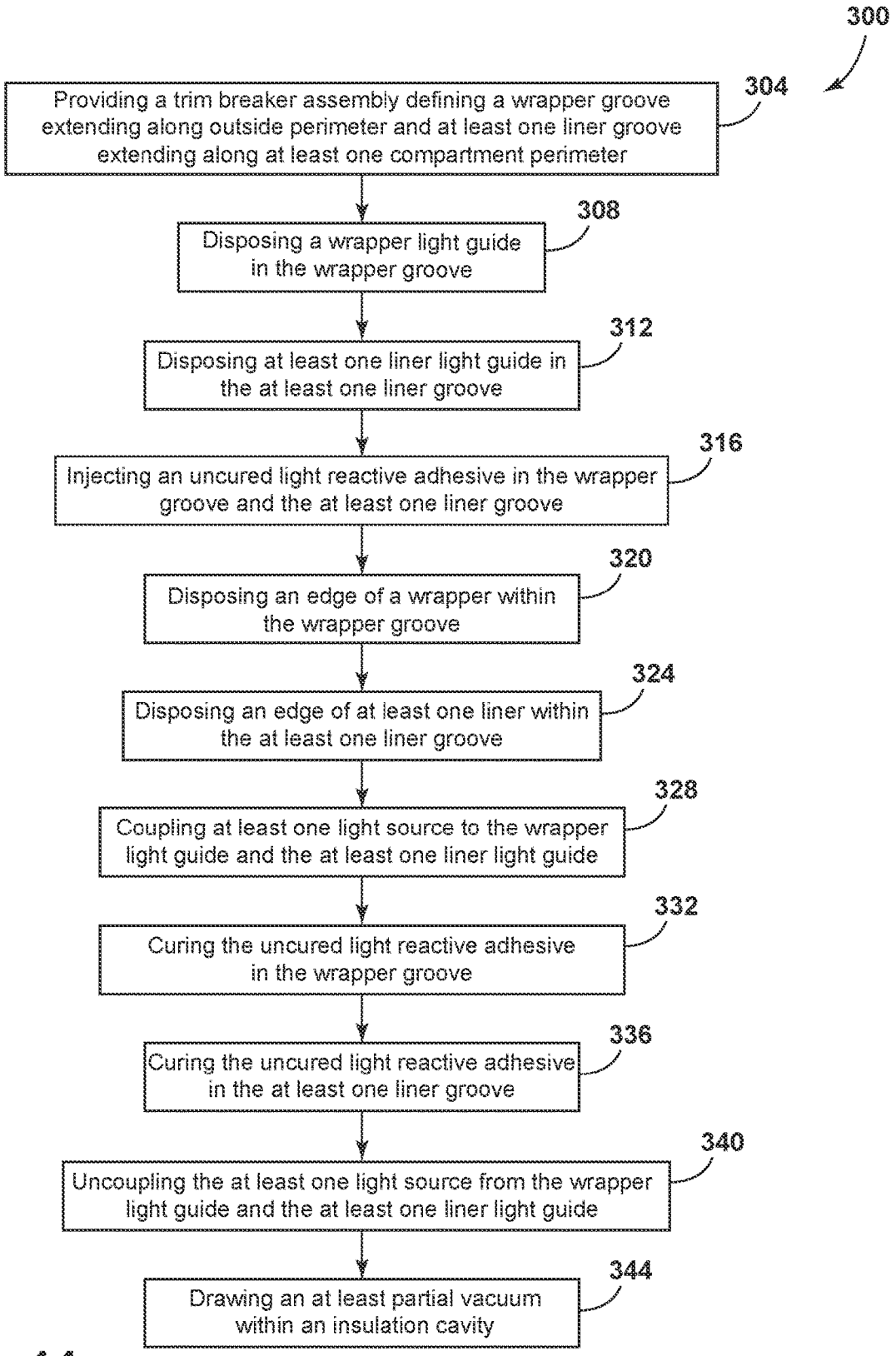
FIG. 11 is a flow diagram of a method of manufacturing a vacuum insulated structure, according to the present disclosure.

Referring to FIG. 11, and with further reference to FIGS. 1-10B, a flow diagram of a method 300 for manufacturing the vacuum insulated structure 10 including the wrapper light guide 32 and/or the liner light guides 34 is illustrated. The method 300 includes step 304 of providing the trim breaker assembly 22 that defines the outer perimeter 136 and at least one compartment perimeter 144, 146. The trim breaker assembly 22 defines the wrapper groove 24 extending along the outer perimeter 136 and the liner groove 28 or liner grooves 28 extending along at least one compartment perimeter 144, 146. The liner grooves 28 may include the refrigerator liner groove **28*a* and the freezer liner groove 28*b***.

Figure 7A:
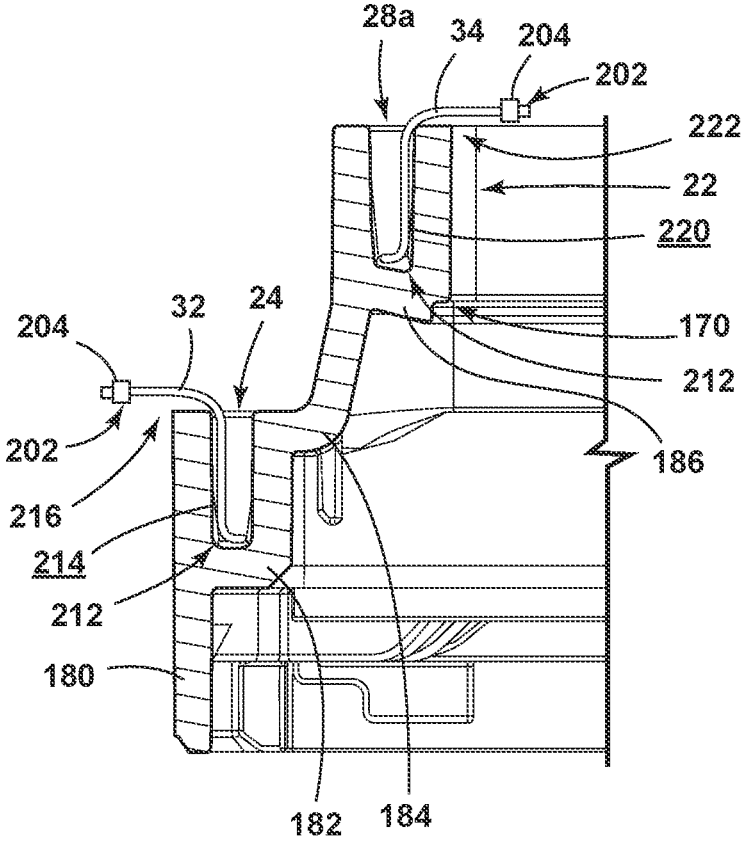
FIG. 7A is a partial cross-sectional view of a trim breaker assembly for a cabinet of a refrigeration appliance, illustrating light guides disposed in grooves, according to the present disclosure.
Figure 7B:
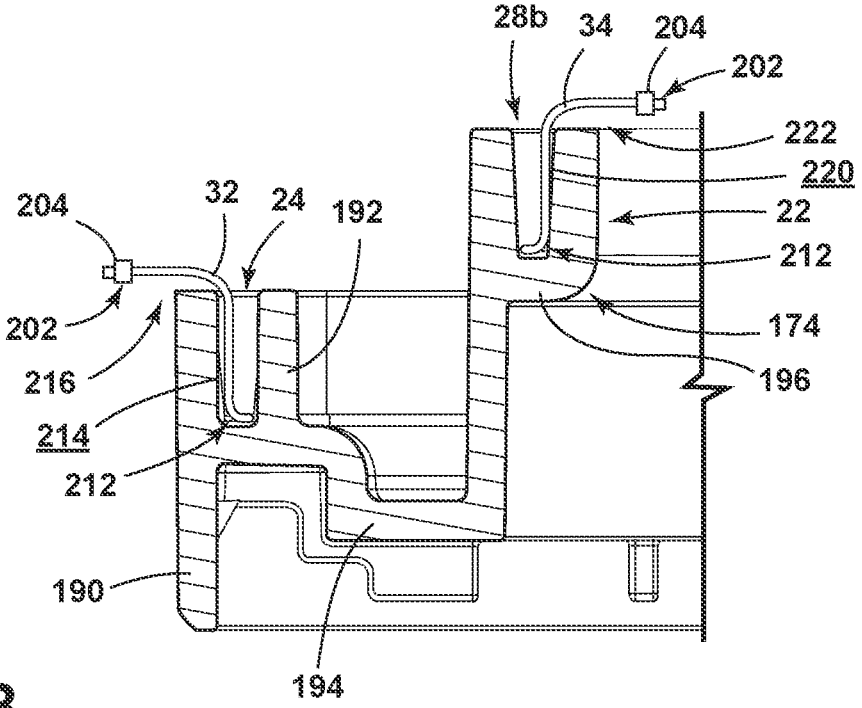
FIG. 7B is a partial cross-sectional view of a trim breaker assembly for a cabinet of a refrigeration appliance, illustrating light guides disposed in grooves, according to the present disclosure.

At step 308, the wrapper light guide 32 is disposed or positioned in the wrapper groove 24, as shown in FIG. 7A. At step 312, the at least one liner light guide 34 is disposed or positioned in the liner groove 28. The liner light guide 34 may include the refrigerator light guide **34*a* and the freezer light guide 34*b*, as shown in FIG. 7B. The refrigerator light guide 34*a* may be disposed in the refrigerator liner groove 28*a*, and the freezer light guide 34*b* may be disposed in the freezer liner groove 28*b***.

Figure 8A:
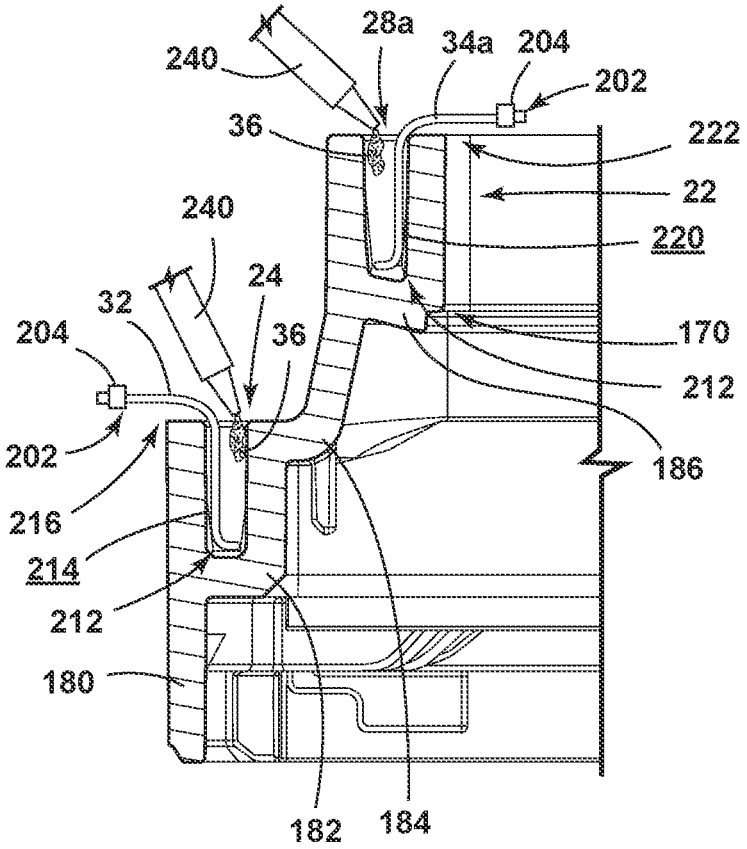
FIG. 8A is a partial cross-sectional view of a trim breaker assembly for a cabinet of a refrigeration appliance, illustrating light guides disposed in grooves with an adhesive being added thereto, according to the present disclosure.
Figure 8B:
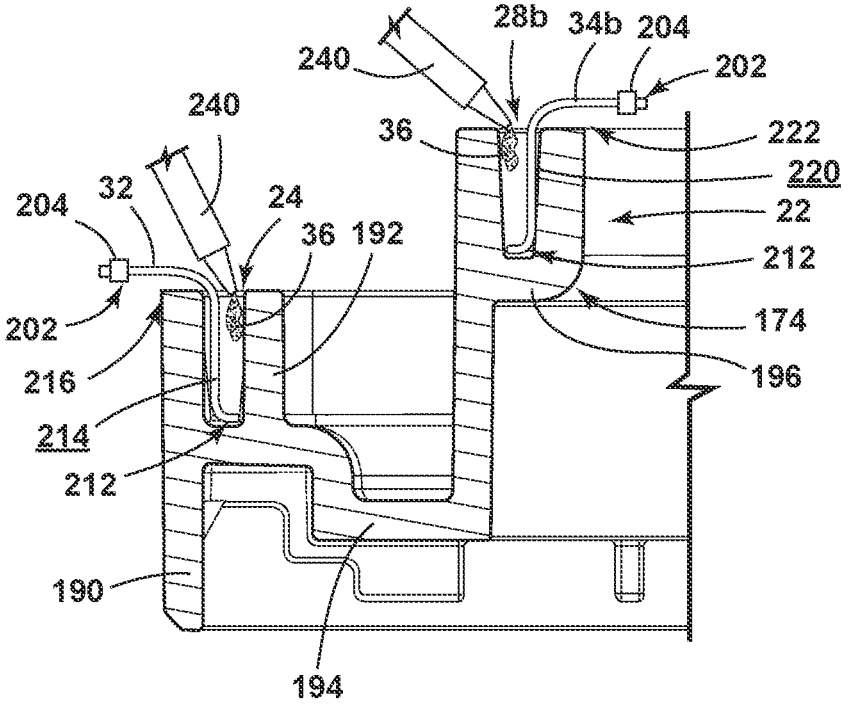
FIG. 8B is a partial cross-sectional view of a trim breaker assembly for a cabinet of a refrigeration appliance, illustrating light guides disposed in grooves with an adhesive being added thereto, according to the present disclosure.

In step 316, the light reactive adhesive 36 in the uncured state (i.e., an uncured light reactive adhesive) is injected into the wrapper groove 24 and the liner groove 28, as shown in FIGS. 8A and 8B. The light reactive adhesive 36 may be injected into the refrigerator liner groove **28*a* and the freezer liner groove 28*b*. The light reactive adhesive 36 may be injected with the adhesive nozzle 240**.

In step 320, the edge 26 of the wrapper 18 is disposed or positioned within the wrapper groove 24 with the uncured light reactive adhesive 36, as shown in FIGS. 9A and 9B. In step 324, the edge 30 of the liner assembly 20 is disposed or positioned within the liner groove 28 with the uncured light reactive adhesive 36, as shown in FIGS. 9A and 9B. The liner assembly 20 may include the refrigerator liner **20*a* and the freezer liner 20*b*. In such examples, the edge 30*a* of the refrigerator liner 20*a* is disposed in the refrigerator liner groove 28*a* with the uncured light reactive adhesive 36, and the edge 30***b* of the freezer liner 20*b* is disposed in the freezer liner groove 28*b* with the uncured light reactive adhesive 36. In steps 320 and 324, the edge 26 of the wrapper 18 and/or the edge 30 of the liner assembly 20 may be disposed within the respective grooves 24, 28 without the uncured light reactive adhesive 36 and the uncured light reactive adhesive 36 may be dispensed into the grooves 24, 28 around the wrapper 18 and the liner assembly 20.

In step 328, at least one light source 200 may be coupled to the wrapper light guide 32 and the liner light guide 34, as shown in FIGS. 10A and 10B. The light source 200 may include first and second light sources 200. The first light source 200 may be coupled to the wrapper light guide 32, and the second light source 200 may be coupled to the liner light guide 34. The light sources 200 may be ultraviolet light sources.

In step 332, the uncured light reactive adhesive 36 in the wrapper groove 24 is cured by diffusing light within the groove 24 with the wrapper light guide 32 and the light source 200. In step 336, the uncured light reactive adhesive 36 in the liner groove 28 is cured by diffusing light within the groove 28 with the liner light guide 34 and the light source 200. The uncured light reactive adhesive 36 in the refrigerator liner groove 28*a* and the freezer liner groove 28*b* is cured by diffusing light within the grooves 28*a*, 28*b* with the refrigerator light guide 34*a* and the freezer light guide 34*b* and the light source 200.

In steps 332 and 336, the light source 200 may be activated for a predetermined amount of time or for predetermined intervals of time to control the curing process. The predetermined amount of time or the predetermined intervals of time may be based on a variety of factors including the configuration of the appliance 10, composition of the adhesive 36, and a desired or selected rate of curing for the manufacturing process. The intensity and wavelength of the light emitted by light source 200 may be varied while the light source 200 activated. The intensity and wavelength of the light may be determined by the composition of the adhesive 36, the rate and physical properties of the adhesive 36 desired or selected for specific steps or points in the manufacturing process, and the configuration of the appliance 10.

In step 340, the light guides 32, 34 may be uncoupled or detached from the light sources 200. The ends 202 of the light guides 32, 34 may be removed by being cut or sheared off. The ends 202 of the light guides 32, 34 may also be disposed in a cavity defined by the trim breaker assembly 22 or in the adhesive 36 if still in the uncured stated when the light source 200 is removed. In this way, the ends 202 may be removed or concealed when manufacturing is complete. In step 344, the at least partial vacuum 70 is drawn in the insulation cavity 52 defined by the wrapper 18 and the liner 20 coupled together with the trim breaker assembly 22. Step 344 may also include coupling the doors 50 to the cabinet 12, adding the components of the refrigeration system, and/or otherwise completing manufacture of the overall appliance 10. The steps of the method 300 may be performed in any order, simultaneously, concurrently, repeated, omitted, etc. without departing from the teachings herein.

Use of the present device may provide a variety of advantages. For example, the light guides 32, 34 may provide for a more efficient curing process of the light reactive adhesive 36. The light guides 32, 34 allow for light to be distributed throughout the grooves 24, 28 to allow for more even activation of the adhesive 36. This may provide for an even or more even curing process throughout the grooves 24, 28 than an external light source without the light guides 32, 34. Moreover, the light guide 32, 34 may provide for a complete or more complete activation of the light reactive adhesive 36 than an external light source without the light guides 32, 34. Further, the light guides 32, 34 and the light reactive adhesive 36 may eliminate or reduce the need to heat the cabinet 12 to activate an adhesive disposed in the grooves 24, 28. By eliminating the heating of the cabinet 12, the components of the cabinet 12 undergo less stress, which may provide for a more rigid structure, the use of less material in the components, and/or the use of materials that may not maintain consistent integrity during a heat cycle. Furthermore, the light guides 32, 34 and the light reactive adhesive 36 may increase the efficiency of the manufacturing process of the cabinet 12 by reducing or eliminating the heating cycle and/or decreasing the curing time of an adhesive disposed in the grooves 24, 28. The light guides 32, 34 and the light source 200 may also allow for more control over the curing process of the adhesive 36 by allowing for the modulation of exposing the adhesive 36 to light. Additional benefits or advantages may be realized and/or achieved.

The device disclosed herein is further summarized in the following paragraphs and is further characterized by combinations of any and all of the various aspects described herein.

According to one aspect of the present disclosure, a vacuum insulated refrigerator includes a cabinet defining at least one compartment. The cabinet includes a wrapper, a liner assembly, and a trim breaker assembly coupled to the wrapper and the liner assembly. The trim breaker assembly defines a wrapper groove to receive an edge of the wrapper and at least one liner groove to receive at least one edge of the liner assembly. A wrapper light-diffusing optical fiber is disposed in the wrapper groove. The wrapper light-diffusing optical fiber is configured to diffuse light within the wrapper groove. At least one liner light-diffusing optical fiber is disposed in the at least one liner groove. The at least one liner light-diffusing optical fiber is configured to diffuse light within the at least one liner groove. A light reactive adhesive is disposed in the wrapper groove and in the at least one liner groove.

According to another aspect, a liner assembly includes a refrigerator liner, at least one compartment includes a refrigerator compartment defined by the refrigerator liner, at least one liner groove includes a refrigerator liner groove, and at least one liner light-diffusing optical fiber includes a refrigerator liner light-diffusing optical fiber. A trim breaker assembly defines an outer perimeter and an inner perimeter and includes a cross member. A wrapper groove extends along the outer perimeter of the trim breaker assembly and the refrigerator liner groove extends along a portion of the inner perimeter and along the cross member to align with a perimeter of the refrigerator compartment. A wrapper light-diffusing optical fiber extends along the outer perimeter of the trim breaker assembly and the refrigerator liner light-diffusing optical fiber extends along the perimeter of the refrigeration compartment.

According to yet another aspect, a wrapper light-diffusing optical fiber extends from a wrapper groove along an outside surface of a wrapper. A refrigerator liner light-diffusing optical fiber extends from a refrigerator liner groove along a compartment surface of a refrigerator liner.

According to another aspect, a liner assembly further includes a freezer liner coupled to a trim breaker assembly. At least one liner light-diffusing optical fiber includes a freezer liner light-diffusing optical fiber. The trim breaker assembly defines a freezer liner groove to receive an edge of the freezer liner. The freezer liner light-diffusing optical fiber is disposed in the freezer liner groove and is configured to diffuse light within the freezer liner groove. A light reactive adhesive is disposed in the freezer liner groove.

According to yet another aspect, a wrapper light-diffusing optical fiber is configured to couple to a light source. At least one liner light-diffusing optical fiber is configured to couple to the light source.

According to another aspect, a light source is configured to emit ultraviolet light.

According to yet another aspect, a wrapper and a liner assembly define an insulation cavity therebetween, where an at least partial vacuum is defined in the insulation cavity.

According to another aspect of the present disclosure, a refrigeration appliance includes a trim breaker assembly defining an outside wrapper groove and at least one liner groove. A light reactive adhesive is disposed in the outside wrapper groove and the at least one liner groove. An outside wrapper is disposed within the outside wrapper groove of the trim breaker assembly. At least one liner is disposed within the at least one liner groove of the trim breaker assembly. The at least one liner defines at least one compartment. A wrapper light guide is disposed in the outside wrapper groove. The wrapper light guide is configured to diffuse light within the outside wrapper groove to cure the light reactive adhesive disposed therein. At least one liner light guide is disposed in the at least one liner groove. The at least one liner light guide is configured to diffuse light within the at least one liner groove to cure the light reactive adhesive disposed therein.

According to another aspect, an outside wrapper and at least one liner define an insulation cavity therebetween, where an at least partial vacuum is defined in the insulation cavity.

According to yet another aspect, at least one liner groove of a trim breaker assembly includes a refrigerator liner groove and a freezer liner groove. At least one compartment includes a refrigerator compartment and a freezer compartment. At least one liner includes a refrigerator liner disposed within the refrigerator liner groove of the trim breaker assembly, the refrigerator liner defining the refrigerator compartment, and a freezer liner disposed within the freezer liner groove of the trim breaker assembly, the freezer liner defining the freezer compartment.

According to another aspect, at least one liner light guide includes a refrigerator light guide disposed in a refrigerator liner groove and a freezer light guide disposed in a freezer liner groove.

According to yet another aspect, each of an outside wrapper light guide and at least one liner light guide is configured to couple to a light source configured to emit light to cure a light reactive adhesive.

According to another aspect, a light source is configured to emit ultraviolet light.

According to yet another aspect, a light reactive adhesive is an epoxy adhesive.

According to yet another aspect of the present disclosure, a method for manufacturing a vacuum insulated appliance includes providing a trim breaker assembly defining a wrapper groove extending along an outer perimeter and at least one liner groove extending along at least one compartment perimeter, positioning a wrapper light-diffusing optical fiber in the wrapper groove, and positioning at least one liner light-diffusing optical fiber in the at least one liner groove. The method further includes injecting an uncured light reactive adhesive in the wrapper groove and the at least one liner groove, positioning an edge of a wrapper within the wrapper groove with the uncured light reactive adhesive, positioning an edge of at least one liner within the at least one liner groove with the uncured light reactive adhesive, curing the uncured light reactive adhesive in the wrapper groove by diffusing light within the wrapper groove with the wrapper light-diffusing optical fiber and at least one light source, and curing the uncured light reactive adhesive in the at least one liner groove by diffusing light within the at least one liner groove with the at least one liner light-diffusing optical fiber and the at least one light source.

According to another aspect, a method includes drawing an at least partial vacuum within an insulation cavity defined between the wrapper and the at least one liner.

According to yet another aspect, a method includes a step of positioning at least one liner light-diffusing optical fiber in at least one liner groove that includes positioning a refrigerator liner light-diffusing optical fiber of the at least one liner light-diffusing optical fiber in a refrigerator liner groove of the at least one liner groove to diffuse light within the refrigerator liner groove and positioning a freezer light-diffusing optical fiber of the at least one liner light-diffusing optical fiber in a freezer liner groove of the at least one liner groove to diffuse light within the freezer liner groove.

According to another aspect, a method includes a step of positioning an edge of at least one liner within at least one liner groove that includes positioning an edge of a refrigerator liner of the at least one liner within a refrigerator groove and positioning an edge of a freezer liner of the at least one liner within a freezer liner groove.

According to yet another aspect, a method includes coupling a wrapper light-diffusing optical fiber with a first light source of at least one light source and coupling at least one liner light-diffusing optical fiber with a second light source of the at least one light source. The first and second light sources are configured to emit ultraviolet light.

According to another aspect, an uncured light reactive adhesive is an epoxy adhesive.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A vacuum insulated refrigerator, comprising:

a cabinet defining at least one compartment, the cabinet including:

a wrapper;

a liner assembly; and a trim breaker assembly coupled to the wrapper and the liner assembly, wherein the trim breaker assembly defines a recessed wrapper groove recessed into the trim breaker assembly to receive an edge of the wrapper and at least one recessed liner groove recessed into the trim breaker assembly to receive at least one edge of the liner assembly;

a wrapper light-diffusing optical fiber disposed in the recessed wrapper groove, wherein the wrapper light-diffusing optical fiber is configured to diffuse light within the recessed wrapper groove;

at least one liner light-diffusing optical fiber disposed in the at least one recessed liner groove, wherein the at least one liner light-diffusing optical fiber is configured to diffuse light within the at least one recessed liner groove; and a light reactive adhesive disposed in the recessed wrapper groove and in the at least one recessed liner groove.

2. The vacuum insulated refrigerator of claim 1, wherein the liner assembly includes a refrigerator liner, the at least one compartment includes a refrigerator compartment defined by the refrigerator liner, the at least one recessed liner groove includes a refrigerator liner groove, and the at least one liner light-diffusing optical fiber includes a refrigerator liner light-diffusing optical fiber, and wherein the trim breaker assembly defines an outer perimeter and an inner perimeter and includes a cross member, and further wherein the recessed wrapper groove extends along the outer perimeter of the trim breaker assembly and the refrigerator liner groove extends along a portion of the inner perimeter and along the cross member to align with a perimeter of the refrigerator compartment, and further wherein the wrapper light-diffusing optical fiber extends along the outer perimeter of the trim breaker assembly and the refrigerator liner light-diffusing optical fiber extends along the perimeter of the refrigerator compartment.

3. The vacuum insulated refrigerator of claim 2, wherein the wrapper light-diffusing optical fiber extends from the recessed wrapper groove along an outside surface of the wrapper, and wherein the refrigerator liner light-diffusing optical fiber extends from the refrigerator liner groove along a compartment surface of the refrigerator liner.

4. The vacuum insulated refrigerator of claim 2, wherein the liner assembly further includes a freezer liner coupled to the trim breaker assembly, and wherein the at least one liner light-diffusing optical fiber includes a freezer liner light-diffusing optical fiber, and wherein the trim breaker assembly defines a recessed freezer liner groove to receive an edge of the freezer liner, and further wherein the freezer liner light-diffusing optical fiber is disposed in the recessed freezer liner groove and is configured to diffuse light within the recessed freezer liner groove, wherein the light reactive adhesive is disposed in the recessed freezer liner groove.

5. The vacuum insulated refrigerator of claim 1, wherein the wrapper light-diffusing optical fiber is configured to couple to a light source, and wherein the at least one liner light-diffusing optical fiber is configured to couple to the light source.

6. The vacuum insulated refrigerator of claim 5, wherein the light source is configured to emit ultraviolet light.

7. The vacuum insulated refrigerator of claim 1, wherein the wrapper and the liner assembly define an insulation cavity therebetween, and wherein an at least partial vacuum is defined in the insulation cavity.

8. The vacuum insulated refrigerator of claim 1, wherein the recessed wrapper groove is defined by a wrapper groove inner wall and a wrapper groove outer wall and the at least one recessed liner groove is defined by a liner groove inner wall and a liner groove outer wall.

9. The vacuum insulated refrigerator of claim 1, wherein the recessed wrapper groove and the at least one recessed liner groove are U-shaped.

10. The vacuum insulated refrigerator of claim 1, wherein the light reactive adhesive is an epoxy adhesive.

11. A refrigeration appliance, comprising:

a trim breaker defining an outside wrapper groove and at least one liner groove, wherein the outside wrapper groove and the at least one liner groove are U-shaped;

a light reactive adhesive disposed in the outside wrapper groove and the at least one liner groove;

an outside wrapper disposed within the outside wrapper groove of the trim breaker;

at least one liner disposed within the at least one liner groove of the trim breaker, wherein the at least one liner defines at least one compartment;

a wrapper light guide disposed in the outside wrapper groove, wherein the wrapper light guide is configured to diffuse light within the outside wrapper groove to cure the light reactive adhesive disposed therein; and at least one liner light guide disposed in the at least one liner groove, wherein the at least one liner light guide is configured to diffuse light within the at least one liner groove to cure the light reactive adhesive disposed therein.

12. The refrigeration appliance of claim 11, wherein the outside wrapper and the at least one liner define an insulation cavity therebetween, and wherein an at least partial vacuum is defined in the insulation cavity.

13. The refrigeration appliance of claim 11, wherein the at least one liner groove of the trim breaker includes a refrigerator liner groove and a freezer liner groove, and wherein the at least one compartment includes a refrigerator compartment and a freezer compartment, and further wherein the at least one liner includes:

a refrigerator liner disposed within the refrigerator liner groove of the trim breaker, the refrigerator liner defining the refrigerator compartment; and a freezer liner disposed within the freezer liner groove of the trim breaker, the freezer liner defining the freezer compartment.

14. The refrigeration appliance of claim 13, wherein the at least one liner light guide includes:

a refrigerator light guide disposed in the refrigerator liner groove; and a freezer light guide disposed in the freezer liner groove.

15. The refrigeration appliance of claim 11, wherein each of the wrapper light guide and the at least one liner light guide is configured to couple to a light source configured to emit light to cure the light reactive adhesive.

16. The refrigeration appliance of claim 15, wherein the light source is configured to emit ultraviolet light.

17. The refrigeration appliance of claim 11, wherein the light reactive adhesive is an epoxy adhesive.

18. The refrigeration appliance of claim 11, wherein the outside wrapper groove and the at least liner groove are recessed into the trim breaker.

19. The refrigeration appliance of claim 11, wherein the outside wrapper groove is defined by a wrapper groove inner wall and a wrapper groove outer wall, and the at least one liner groove is defined by a liner groove inner wall and a liner groove outer wall.

* * * * *